United States Patent [19]

Wolf

[11] 4,179,119

[45] Dec. 18, 1979

[54] SKIPPING ROPE OR WIRE

[76] Inventor: Gerard Wolf, Oliggasse 46, D-6733 HaBlock, Fed. Rep. of Germany

[21] Appl. No.: 890,985

[22] Filed: Mar. 28, 1978

[30] Foreign Application Priority Data

Apr. 12, 1977 [DE] Fed. Rep. of Germany ..... 2716107

[51] Int. Cl.[2] ..... A63B 5/20

[52] U.S. Cl. ..... 272/75; 272/DIG. 4

[58] Field of Search ..... 272/75, 74, 67, 68, 272/143; 46/1 G, 77, 47; 273/26 E, 58 C, 95 A, 97 R, 97 A, 98, 99; 16/115, 110 R; 74/557, 547, 544, 551.8

[56] References Cited

U.S. PATENT DOCUMENTS

| | | | |
|---|---|---|---|
| 438,489 | 10/1890 | Pringle | 272/75 |
| 1,245,917 | 11/1917 | Hewitt | 74/557 X |
| 1,371,915 | 3/1921 | Logan | 272/75 |
| 2,039,731 | 5/1936 | Martin | 46/1 G |
| 2,253,075 | 8/1941 | Johnson | 272/75 |

FOREIGN PATENT DOCUMENTS

| | | | |
|---|---|---|---|
| 2641383 | 3/1978 | Fed. Rep. of Germany | 272/75 |
| 605358 | 2/1926 | France | 272/75 |
| 1109242 | 9/1955 | France | 272/75 |
| 433319 | 8/1935 | United Kingdom | 272/68 |

*Primary Examiner*—Richard C. Pinkham
*Assistant Examiner*—Arnold W. Kramer
*Attorney, Agent, or Firm*—Burns, Doane, Swecker & Mathis

[57] ABSTRACT

A skipping rope employing a wire rope and wooden handles which include an apparatus for permitting the handles to rotate freely with respect to the rope. The wooden handles include an axial bore which has a central section of reduced diameter in which is mounted a metal peg by means of a bushing supported inside the handle bore. The peg protrudes from the handle and engages a rope-accommodating part through which the rope may be looped. Sleeves may be used in conjunction with the rope-accommodating part to hold the rope securely in position.

14 Claims, 11 Drawing Figures

$D_1$
16
14
26
28
12
$D_2$
18
24
20
22
30
34
38
10
36
32
40

SKIPPING ROPE OR WIRE

FIELD OF THE INVENTION

The invention concerns a skipping rope, especially a skipping wire made of steel, with handles attached at the ends, especially handles made of wood.

BACKGROUND OF THE INVENTION

It is known to provide skipping ropes with handles that are arranged at their ends to facilitate their use during training. Several skipping ropes are known with handles attached to their ends; these handles are usually arranged fixedly at the ends of the ropes with the result that at this specific point of transition from handle to end of the rope high stresses occurred, resulting as a matter of course in a premature destruction of the rope. Futhermore, the handles were attached in many instances in such manner that the skipping rope was difficult to handle. This is due to the fact that the connection between skipping rope and handle is usually rigid so that the rotating motion must overcome frictional forces which will impede the very rapid circulation of the rope.

It is the aim of the invention to provide a skipping rope or wire of the above defined type where these disadvantages are eliminated. It is especially desired to improve the handiness of the skipping rope during the workout so that a most rapid rotation of the rope will be possible. It is further desired to keep the manufacture as simple as possible.

SUMMARY OF THE INVENTION

The invention solves these and other problems of the prior art by providing a peg rotatably supported within each handle. The peg protrudes from the handle and at the free end of the peg there is fastened a rope-accommodating part which has at least two grooves. The rope ends are inserted or looped in a U-shape into two grooves and held therein being relieved of tension. The peg is preferably provided with a crown-like expansion which fits snugly against a shoulder inside the handle; the shoulder is thus the place of transition from a first section with a diameter matching and slightly larger than the diameter of the crown-like expansion to a second section with a diameter matching and slightly larger than the diameter of the peg. The internal bore of the handle accommodating the peg has, at its region adjacent to the rope end, a third expanded section, whose inner diameter corresponding to the inner diameter of the first section. This third section is equipped with a removable sleeve which can serve as bushing for the peg. The bushing can be designed in the form of a journal-bearing bushing or a roller bearing bushing or ball bearing bushing. If the sleeve is removed from this third section and is inserted into the first section, the crown-like expansion of the peg will rest against the front rim of the sleeve with the result that the peg will protrude from the handle to a lesser degree only, or respectively the rope-accommodating part will submerge partially inside the handle; this makes it feasible to modify the force which is applied by the rope to the hand during the rope-skipping exercise, Alternatively a bushing may be mounted in both the first and third sections.

The rope-accommodating part can have traverse bores or grooves, allowing the rope end to be pushed through the two traverse bores, or respectively to be inserted into the traverse grooves in U-shape. In the latter case, a sleeve is required in order to hold the rope within the traverse grooves. The sleeve can be provided with a first slot, designed in the form of an oblong hole, and a second slot extending over the entire length of the sleeve. The first slot embraces the bent portion of the rope end which projects over the perimeter of the rope-accommodating part and is dimensioned accordingly. If the rope-accommodating part is provided with a longitudinal groove which overlaps the traverse grooves and which possesses a depth matching approximately the thickness of the rope, the second slot within the sleeve will be needed but not the first slot. In place of the first slot there can then be provided at least one recess which moves away from the center line of the sleeve and which covers and accommodates the portion of the rope protruding from the rope-accommodating part. In this manner the sleeve is sufficiently secured to prevent any sliding. If the longitudinal groove is machined in such manner that it extends to the center axis of the rope-accommodating part, there will be no need to provide the sleeve with a recess; it was found that even the sleeve will not be needed if adhesive tape is wound around the rope end.

DESCRIPTION OF THE DRAWING

Further advantages and features of the invention will be apparent from the following detailed description of the invention taken in conjunction with the following drawings in which.

DESCRIPTION OF THE PREFERRED EMBODIMENT

Figure 1:
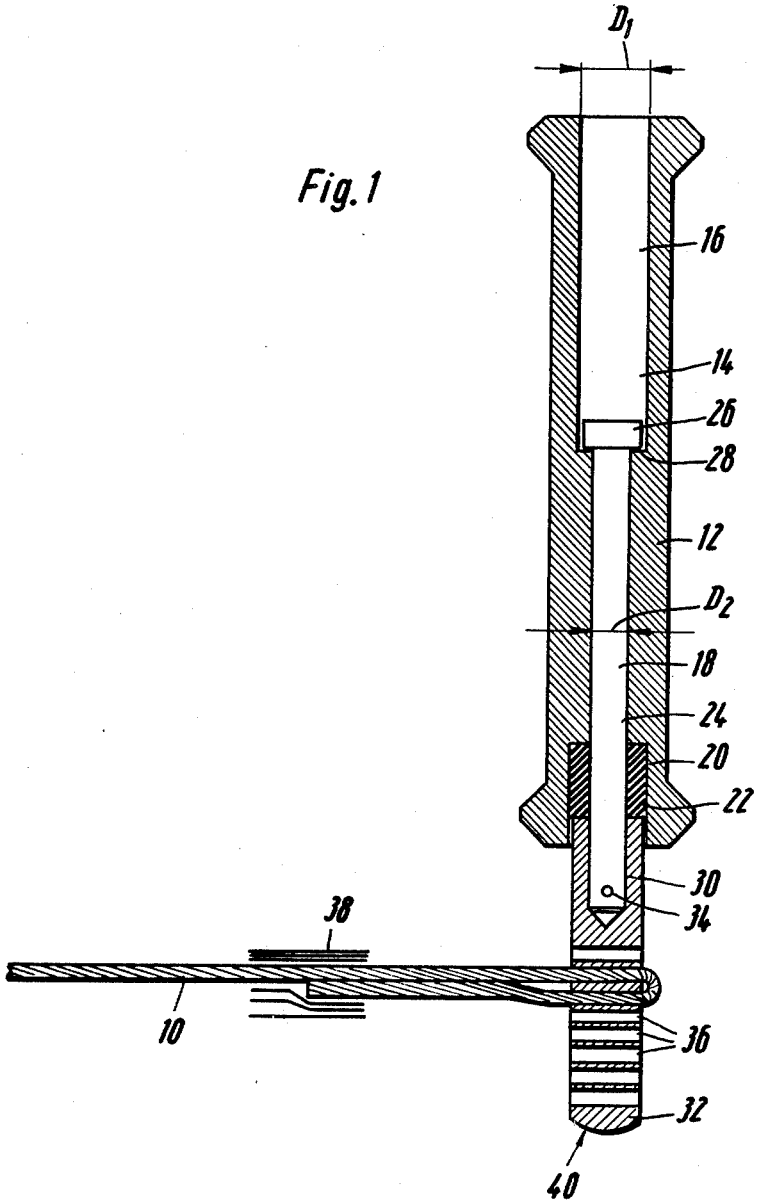
FIG. 1 shows a longitudinal cross-section of a handle to which a rope is attached.

The skipping rope illustrated in FIG. 1 has a rope 10 which is made of metal and which is connected to a handle 12, made of wood, preferably beech. This handle 12 has an inner bore 14, subdivided into three sections: a first section 16 with expanded diameter $D_1$, a second section 18 with reduced diameter $D_2$ and a third section 20, whose inner diameter is equal to the inner diameter $D_1$ of the section 16. The section 16 extends axially approximately to the middle of the handle 12 while the third section 20 is relatively short and serves, in the case illustrated, to hold a journal-bearing bushing 22. Alternatively, bushing 22 may be placed in first section 16. Into the inner bore 14 there is inserted a cylindrical peg 24 which carries a crown-like expansion 26, the outer diameter of which is slightly less than the diameter $D_1$ of the first section.

This crown-like expansion 26 rests at the shoulder 28 which forms the transition between the section 16 and the section 18. The inner diameter of the section 18 corresponds to but is slightly greater than the outer diameter of the peg 24. The length of peg 24 is such that its end 25 opposite expansion 26 will pass through the journal-bearing bushing 22 and then protrudes from the handle 12 when expansion 26 is resting on shoulder 28. The diameter of peg 24 is slightly less than the diameter $D_2$ of second section 18 so that peg 24 can freely slide axially or rotate in second section 18. The free, protruding end 25 of peg 24 is inserted, as illustrated in FIG. 1, into a blind-end bore 30 of a cylindrical rope-accommodating part 32 and is secured by a locking element 34 which passes through two aligned bores of the part 32 and of the free end of peg 24. It is also possible to utilize a notched pin, a clamping sleeve or spring-locking element for this purpose. The rope-accommodating part 32 is provided with traverse bores 36, namely a total of seven traverse bores in case of the embodiment illustrated in FIG. 1. FIG. 1 shows that the end of rope 10 has been looped through two of the tranverse bores 36 in rope-accommodating part 32 with the free end of the rope facing the center of the rope after it has been looped through rope-accommodating part 32. In order to eliminate any danger of injuries at the open rope end, a piece of adhesive tape 38 can be wound around the free end and the adjacent area of the rope. While the handle, as mentioned above, is made of wood, especialy beech, in various shapes and forms, the peg 24 is made of steel, preferably high-strength steel. The rope-accommodating part 32 can likewise be manufactured from steel; however, it is also possible to make this part from an aluminum pressure casting or from a hard, elastic synthetic material such as duroplast. The free end of the rope-accommodating part 32 is provided with a knob 40 in order to prevent any injuries. In order to permit the peg 24 to turn about its axis within the handle 12 when the rope is being manipulated, the inner wall of the second section 18 is coated with a non-liquid lubricant such as graphite or the like, to insure proper lubrication. A non-liquid lubricant is used to avoid swelling of the wood which could lead to a jamming of peg 24.

Obviously, it is also possible to manufacture the handle 12 from a synthetic material; in this case the lubrication will present a lesser problem under certain circumstances.

Figure 2:
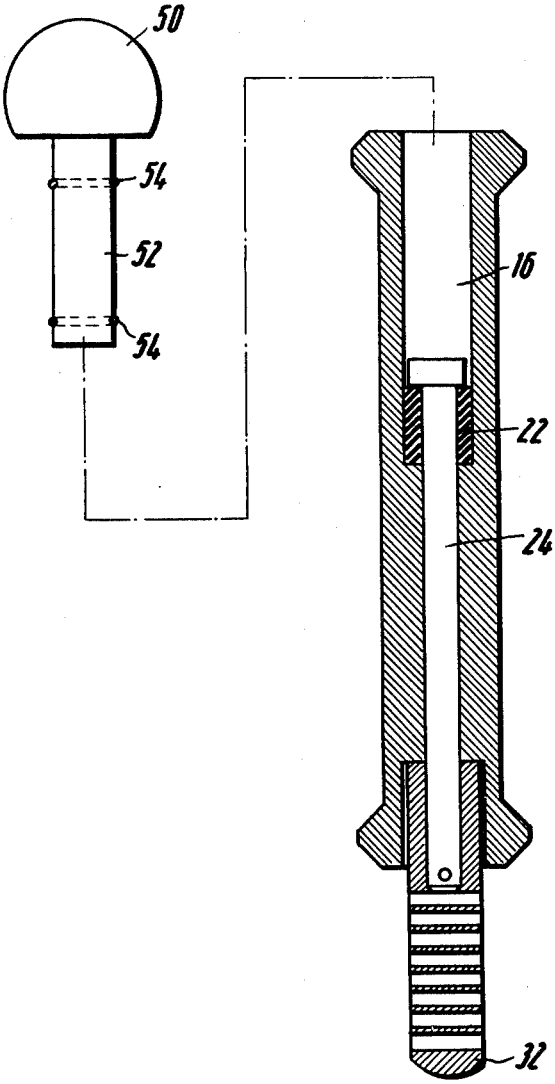
FIG. 2 shows a handle which is similar to the handle of FIG. 1 in longitudinal cross-section.

In the case of the embodiment illustrated in FIG. 1, the journal-bearing bushing 22 is located in the area of the handle adjacent to the rope. By changing the location of the journal-bearing bushing 22, it is feasible to attain a shift in the applied moment of force similar to a change accomplished by changing the traverse bores 36 through which the rope end is looped. This is accomplished by moving bushing 22 from the location shown in FIG. 1 and inserting it into first section 16 with the result that the rope-accommodating part 32 will project partially into the area 20 (See FIG. 2). One end of bushing 22 will rest upon shoulder 28 and the other end will support crown-like expansion 26.

It is further possible to insert a weight into the first section 16 in order to attain a change in the handle balance during the exercise. For this purpose there is inserted a mushroom-like part 50 with a cylindrical extension 52 into the inner bore within first section 16 of the handle. The components are retained within the inner bore at first section 16 by circular rubber rings 54 which will keep the mushroom-like part 50 in its place within the first section 16 by friction contact.

Figure 3:
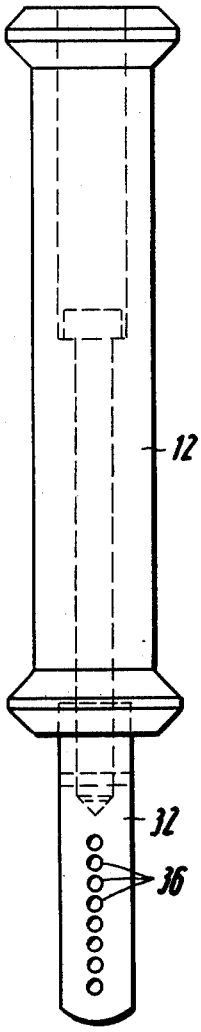
FIG. 3 depicts a side elevation of the handle, shown in FIG. 1.
Figure 4:
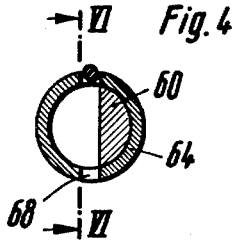
FIG. 4 gives a sectional view of another enbodiment of the invention.
Figure 6:
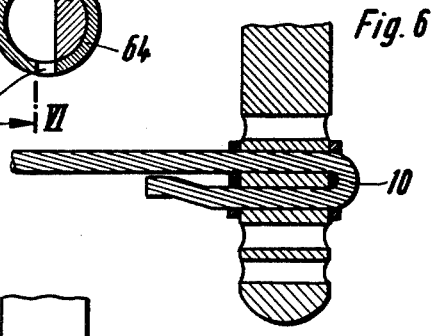
FIG. 6 gives a sectional view of the rope-accommodating part along line VI—VI of FIG. 4.
Figure 5:
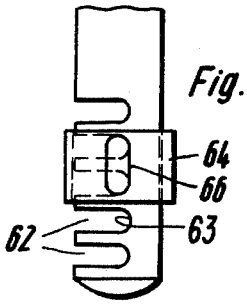
FIG. 5 gives a partial view of a rope-accommodating part provided with traverse grooves.

FIG. 3 shows clearly the position of the bores 36. It is also possible to arrange traverse grooves within the rope-accommodating part in place of traverse bores 36. This arrangement is illustrated in FIGS. 4 to 6. The rope-accommodating part is denoted by numeral 60 and possesses a cylindrical profile as shown by FIG. 4. Obviously, it is also possible to select a square profile, a design which facilitates the manufacture of the rope-accommodating part.

Referring now to FIG. 5, rope-accommodating part 60 is provided with traverse grooves 62 with rounded bottoms 63 but the bottom can also be kept angular for reasons of economy. The traverse grooves 62, produced by milling, extend over the center axis of the rope-accommodating part 60 and specifically so far that the center line of the inserted end of rope 10 will be located precisely at the center axis of the rope-accommodating part 60. For the purpose of keeping the rope end inside the traverse grooves 62 there is provided a sleeve 64, whose inner diameter matches the outer diameter of the rope-accommodating part 60 so that the sleeve 64 is seated firmly at the rope-accommodating part 60. The sleeve has a first slot 66 which is designed in the form of an oblong hole and which is dimensioned so that it just embraces the bent portion of the rope 10 which protrudes from rope-accommodating part 60. At the opposed side the sleeve is provided with a second slot 68, likewise designed in the form of an oblong hole. The rope is installed by pushing it through the slots and the traverse grooves as in case of the embodiments shown in FIGS. 1 to 3. The first slot 66, shaped in the form of an oblong hole, serves to center rope 10 and will hold it firmly in its proper position. The rope-accommodating part 60 is then fastened to the handle in the same manner as the rope-accommodating part 32, described in connection with FIGS. 1 to 3 above.

Figure 7:
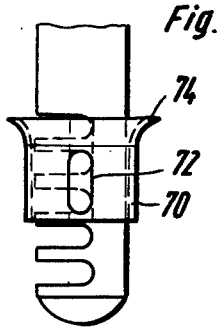
FIG. 7 shows another design of the sleeve, similar to the embodiment illustrated by FIG. 5.

FIG. 7 shows a sleeve design which is similar to the embodiment of FIG. 6. This sleeve is denoted by reference numeral 70 and has a first slot 72 which is designed in the form of an oblong hole and which has the same function as the first slot 66 of sleeve 64 shown in FIG. 5. At the opposite side of sleeve 70 is slotted axially over its entire length so that sleeve 70 is generally "C" shaped. The sleeve 70 is provided, within the region of one edge, with a plunger-shaped widening 74 so that it can be pushed more easily over the bent portion of the rope 10 protruding over the rope-accommodating part 60.

The sleeve 64 can be manufactured from standard tubular material but the sleeve 70 should be produced from spring plate, or a material possessing good elastic qualities.

Figure 8:
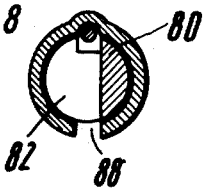
FIGS. 8 to 11 show other embodiments of the rope-accommodating part with sleeve, their presentation similar to the presentation used in FIGS. 4 to 6.
Figure 10:
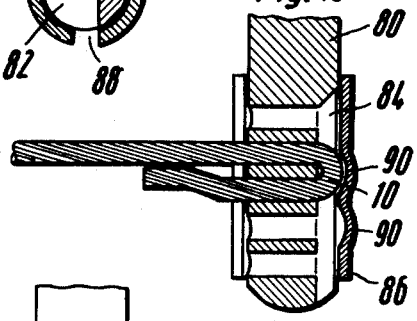
Figure 9:
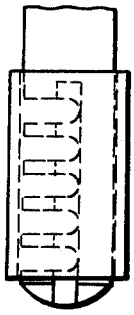

FIGS. 8 to 10 illustrate still another embodiment of the sleeve and of the rope-accommodating part. Referring now to FIGS. 8 and 10, the rope-accommodating part, denoted by reference numeral 80, is again equipped with traverse grooves 82 which correspond to the traverse grooves 62 of FIG. 5. Also rope-accommodating part 80 is provided with a longitudinal groove 84, overlapping all traverse grooves 82, its depth corresponding approximately to the thickness of the inserted rope. A portion of the rope protrudes just over the outer contour of the rope-accommodating part 80. The rope 10 is kept securely inside the traverse grooves 82 by means of a sleeve 86 which is provided on one side with a continuous slot 88. At the other side, opposed to the slot 88, there are provided two depressions or recesses 90 which fit snugly to the bent portion of the rope 10, thereby securing the sleeve against sliding. This is clearly depicted in FIG. 8 as well as in FIG. 10. Spring steel is used preferably for the sleeve 86. Obviously, it is also possible to provide one recess only in place of the two recesses shown.

Figure 11:
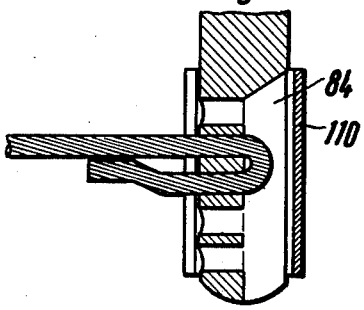

FIG. 11 shows that it is also possible to increase the depth of the longitudinal groove 84 substantially, in the case illustrated in FIG. 11 approximately down to the center axis of the rope-accommodating part 80. In this case a tube 110, slotted on one side only, can be used as sleeve. It was found that in the case of this specific design, the sleeve or tube 110 may be omitted if the rope is held in place within the traverse grooves and the longitudinal groove by adhesive tape 38 wound around the rope end as shown in FIG. 1.

It should be pointed out that the sleeve 110 with the longitudinal slot does require means to prevent any sliding. This can be attained in a simple manner, namely by designing the slot in the form of an oblong hole so that the end portions of the slot, facing each other, will embrace the rope. However, in this case it will become necessary to use a material with resilient qualities for the manufacture of the sleeve 110 so that the slot can be bent up to allow its insertion.

As shown above, it is possible to attain a change in the force applied by the rope to the handle, and thereby to the hand by removing the journal-bearing bushing 22, serving as spacer bush, from third section 20 and inserting the same into first section 16. An additional adjustment is possible by rearranging the rope within two traverse bores 36, or grooves respectively which are located in the region of the handle, or into traverse grooves or bores which are further removed from the handle.

My invention has been described with reference to preferred embodiments. However, many modifications and improvements may occur to those skilled in the art, without departing from my invention. It is therefore not intended to limit the scope of my invention to this preferred embodiment except as claimed in the appended claims.

What is claimed is:

1. A skipping rope with handles attached at the ends, each said handle having a longitudinal axis and comprising:

a peg rotatably supported within each handle, said peg protruding axially from said handle; and a rope-accommodating part fastened to the free end of said peg and extending along the handle axis, said part having a plurality of means spaced along said axis whereby a rope end may be selectively connected to one of said means to hold the rope in an adjusted position relative to said handle.

2. A skipping rope according to claim 1 wherein each of said handles includes an axially extending bore having a first section with a first diameter extending from one end of said handle axially a first predetermined distance to a second section, said second section having a second diameter less than said first diameter and extending axially a second predetermined distance to a third section; said third section having a diameter substantially equal to the diameter of said first section and extending axially to the other end of the handle.

3. A skipping rope according to claim 2 wherein said peg includes a crown-like expansion resting on a shoulder defined at the interface of said first and second sections of said axial bore in each of said handles.

4. A skipping rope according to claim 2 further including a mushroom like weight whose stem is frictionally engaged in said first section.

5. A skipping rope according to claim 1 further including a bushing means mounted in said handle and operatively engaging said peg to facilitate the rotation of said peg about its axis in said bore.

6. A skipping rope according to claim 5 wherein the diameter of the rope-accommodating part corresponds to the diameter of said bushing means.

7. A skipping rope according to claim 5 wherein said bushing means includes a journal-bearing bushing.

8. A skipping rope according to claim 5 wherein said bushing means includes a ball bearing.

9. A skipping rope according to claim 1 wherein said rope-accommodating part includes:

an axially extending blind-end bore into which is inserted the protruding end of said peg; and, a locking means disposed in said rope-accommodating means and adapted for securing said protruding end of said peg into said bore.

10. A skipping rope according to claim 1 wherein said axially spaced means of said part comprise recesses within said rope-accommodating part and include bores extending transversely relative to said axis and into which the rope end may be inserted.

11. A skipping rope according to claim 1 wherein said axially spaced means of said part comprise recesses within said rope-accommodating part and include grooves extending transversely relative to said axis and into which said rope end may be inserted.

12. A skipping rope according to claim 1 further including:

a sleeve adapted to cooperate with said rope-accommodating part to hold said rope, said sleeve having:

a first slot in the form of an oblong hole extending parallel to said axis through one portion of said sleeve, said oblong hole having its larger dimension sized such that said oblong hole closely embraces bent portions of the rope end which protrudes over the rope-accommodating part; and, a second slot in an opposed portion of said sleeve extending the entire length of said sleeve parallel to said axis.

13. A skipping rope according to claim 1 wherein said axially extending means on said part comprise recesses extending transversely relative to said axis, said rope-accommodating part includes:

a groove extending parallel to said axis and overlapping said recesses, the depth of said groove being less than the thickness of said rope; and, a sleeve adapted to cooperate with said rope-accommodating part to hold said rope, said sleeve having:

at least one depression matching the bent portion of said rope and protruding over the perimeter of the rope-accommodating part thus securing said rope against sliding.

14. A skipping rope according to claim 1 wherein said axially extending means on said part comprise recesses extending transversely relative to said axis, said rope-accommodating part includes:

a groove extending parallel to said axis and overlapping said recesses, the depth of said groove reaching approximately to the axis of said rope-accommodating part.

* * * * *